US008613582B2

(12) United States Patent
Shani

(10) Patent No.: US 8,613,582 B2
(45) Date of Patent: Dec. 24, 2013

(54) SHUTTLE CARS FOR USE IN AUTOMATED PARKING

(75) Inventor: Haim Shani, Shoham (IL)

(73) Assignee: Unitronics Parking Solutions Ltd, Ben Gurion Airport (IL)

( * ) Notice: Subject to any disclaimer, the term of this patent is extended or adjusted under 35 U.S.C. 154(b) by 356 days.

(21) Appl. No.: 12/573,480

(22) Filed: Oct. 5, 2009

(65) Prior Publication Data

US 2010/0086385 A1 Apr. 8, 2010

Related U.S. Application Data

(60) Provisional application No. 61/103,087, filed on Oct. 6, 2008.

(51) Int. Cl.

| | |
|---|---|
| ***E04H 6/22*** | (2006.01) |
| ***E04H 6/34*** | (2006.01) |
| ***E04H 6/28*** | (2006.01) |
| ***E04H 6/40*** | (2006.01) |

(52) U.S. Cl.
USPC ..... 414/240; 414/232; 414/234; 414/239; 414/241; 414/245; 414/253; 414/257; 414/807

(58) Field of Classification Search
USPC ..... 414/232, 234, 239, 240, 241, 245, 257, 414/253, 807
See application file for complete search history.

(56) References Cited

U.S. PATENT DOCUMENTS

| | | | | |
|---|---|---|---|---|
| 2,833,435 | A * | 5/1958 | Levy | 414/592 |
| 2,899,087 | A * | 8/1959 | Jacobsen | 414/252 |
| 4,103,795 | A * | 8/1978 | Miller | 414/608 |
| 4,252,495 | A * | 2/1981 | Cook | 414/608 |
| 4,655,669 | A * | 4/1987 | Anttila et al. | 414/458 |
| 4,801,238 | A * | 1/1989 | Pezzolato | 414/607 |
| 5,108,254 | A | 4/1992 | Go | |
| 5,286,156 | A * | 2/1994 | Ikenouchi et al. | 414/256 |
| 5,320,473 | A * | 6/1994 | Arnold et al. | 414/253 |
| 5,330,305 | A | 7/1994 | Go | |
| 5,669,753 | A | 9/1997 | Schween | |
| 5,863,171 | A * | 1/1999 | Engman | 414/256 |
| 7,736,113 | B2 * | 6/2010 | Yook et al. | 414/256 |
| 7,740,438 | B2 * | 6/2010 | Xiang et al. | 414/256 |
| 2004/0067124 | A1 * | 4/2004 | Lee | 414/234 |
| 2008/0031711 | A1 * | 2/2008 | Yook et al. | 414/253 |
| 2010/0034626 | A1 * | 2/2010 | Reiniger et al. | 414/253 |

OTHER PUBLICATIONS

"Boomerang Automated Parking", available at hypertext transfer protocol://www.youtube.com/watch?v=UGH4Ir6SfhM; uploaded by chrismulvihill on Jun. 22, 2008.

(Continued)

*Primary Examiner* — Scott Lowe
(74) *Attorney, Agent, or Firm* — Eitan, Mehulal & Sadot

(57) ABSTRACT

A system of shuttle cars for transporting a vehicle in an automated parking facility. Each shuttle car includes an x-shuttle that supports two z-shuttles. The z-shuttles move from the x-shuttle and under the vehicle for transport. The z-shuttles locate and engage the front and rear tires of a vehicle to lift the vehicle from the floor. Once the z-shuttles have engage the vehicle tires, the z-shuttles return to the x-shuttle so that the x-shuttle can transport the vehicle (and the z-shuttles) to and from the appropriate parking space.

19 Claims, 13 Drawing Sheets

(56) References Cited

OTHER PUBLICATIONS

"Boomerang Automated Parking System", available at hypertext transfer protocol://www.youtube.com/watch?v=pZcz5HqSKvw; uploaded by woodman202 on Jun. 22, 2008.
"Automated Parking Tower", available at hypertext transfer protocol://www.youtube.com/watch?v=wH2BEqhSIVc; uploaded by chrismulvihill on Sep. 26, 2008.
"Boomerang—Tower Video", available at hypertext transfer protocol://www.youtube.com/watch?v=27qPfSdGZsM; uploaded by chrismulvihill on Sep. 26, 2008.
"MPSystem's Automatic Parking System—The Future of Parking Now" avail. at hypertext transfer protocol://www.youtube.com/watch?v=EWb5LIFE69Y; uploaded by seankim on May 1, 2007.
"Apex Skypark—The Robotic Parking Solution", available at hypertext transfer protocol://www.youtube.com/watch?v=LW2X0SY0KKk; uploaded by tmg872 on Mar. 22, 2008.
"FATA Skyparks", available at hypertext transfer protocol://www.youtube.com/watch?v=TXv4W606_W4; uploaded by eprysby on Jan. 15, 2008.
"Parking Videos", available at hypertext transfer protocol://www.boomerangsystems.com/Content.aspx?nid=10&cid=2017; published at least as early as Jan. 5, 2010.

* cited by examiner

SHUTTLE CARS FOR USE IN AUTOMATED PARKING

CROSS-REFERENCE TO RELATED APPLICATIONS

This application claims priority to U.S. provisional application No. 61/103,087, filed Oct. 6, 2008, which is incorporated herein by reference.

BACKGROUND OF THE INVENTION

In a conventional three-dimensional automated vehicle parking garage, mechanical elements or motorized conveyances, such as lifts (elevators), cranes, shuttle cars (moving platforms), turntables, and other mechanical elements are used to transport a vehicle from an entry/exit station at the arrival/departure level of the parking garage to a parking space in the parking garage and then retrieve the vehicle from the parking space and transport the vehicle to the entry/exit station, without human assistance.

In general, a typical automated vehicle parking garage consists of a storage (or parking) area with individual parking spaces, one or more entry/exit stations (or bays) for accepting a vehicle from a customer for parking and for delivering the vehicle to the customer upon retrieval, and motorized conveyances (mechanical elements), such as elevators and shuttle cars, used to transport the vehicle from the entry/exit station to the parking space and to transport the vehicle from the parking space to the entry/exit station for customer retrieval.

A conventional shuttle car typically comprises a single, unitary platform capable of raising a vehicle using hydraulic or other means and transporting the vehicle in a horizontal direction.

SUMMARY OF THE INVENTION

Disclosed herein is a system of improved shuttle cars for transporting a vehicle in an automated parking facility. The disclosed system provides for faster storage and retrieval of vehicles than can be obtained by prior art shuttle cars. In particular, the shuttle cars disclosed herein operate independently to locate the front and rear tires of a vehicle, lift the vehicle from the floor, and transport the vehicle to the appropriate parking spot.

The shuttle cars disclosed herein also provide for improved maintenance, flexibility, and fault tolerance. Redundant and interchangeable systems are built into the shuttle cars, thus enabling easy maintenance of shuttle cars and the rapid replacement of malfunctioning components.

DETAILED DESCRIPTION

Figure 1:
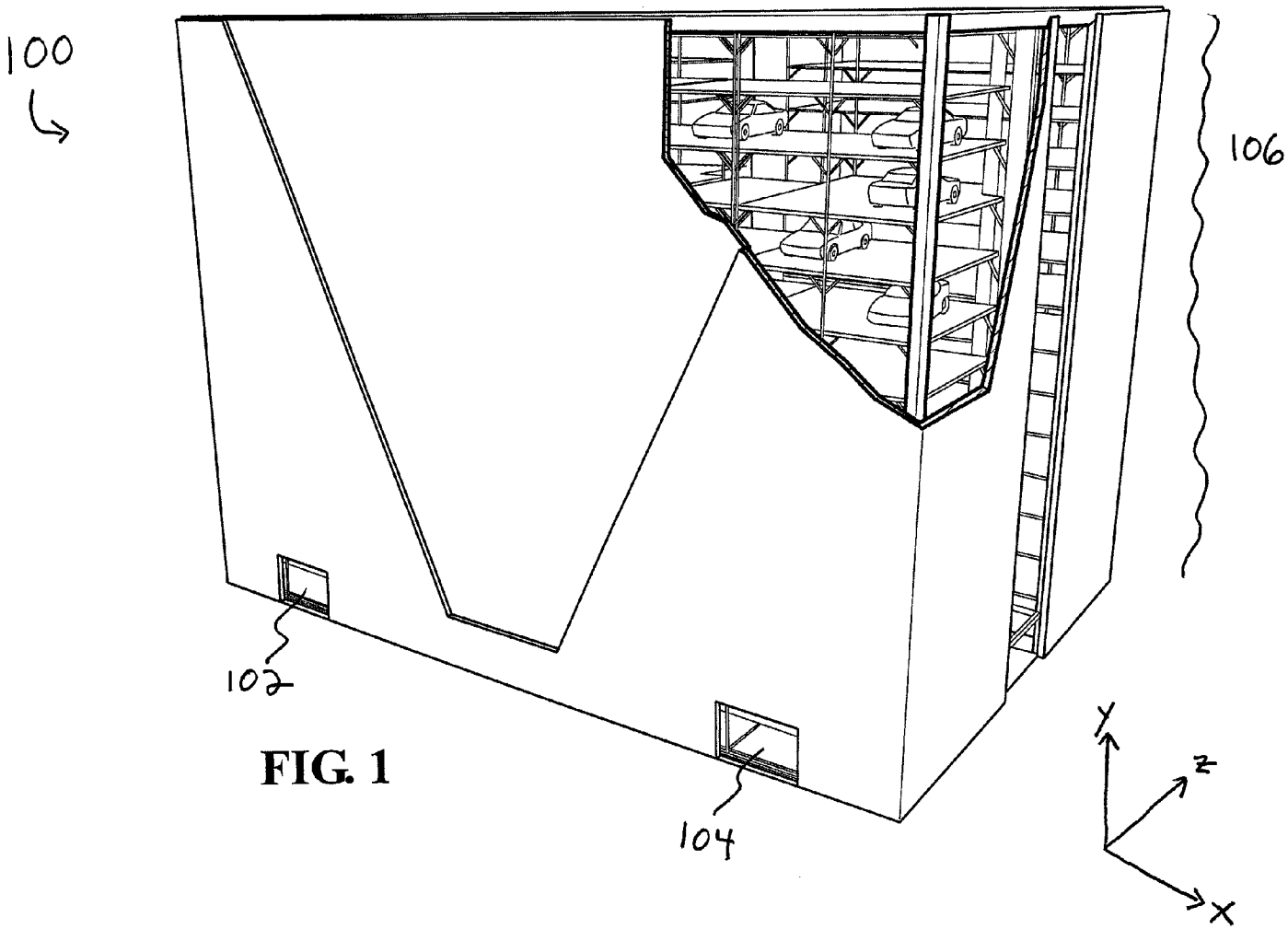
FIG. 1 is a perspective cut-away view of a three-dimensional automated vehicle parking garage.

Referring to FIG. 1, a three-dimensional automated vehicle parking garage 100 is shown. The garage comprises a plurality of levels 106 which contain parking spaces for automobiles. Customers can drive into the garage 100 through two entry/exit bays 102, 104. Alternate embodiments can have more than two bays or only a single bay. In addition, certain embodiments may have separate entry and exit bays so vehicle traffic into and out of the garage is one-way. As shown in FIG. 1, the automated vehicle parking garage 100 can be characterized as having a width (x-axis), a height (y-axis), and a depth (z-axis).

Figure 2:
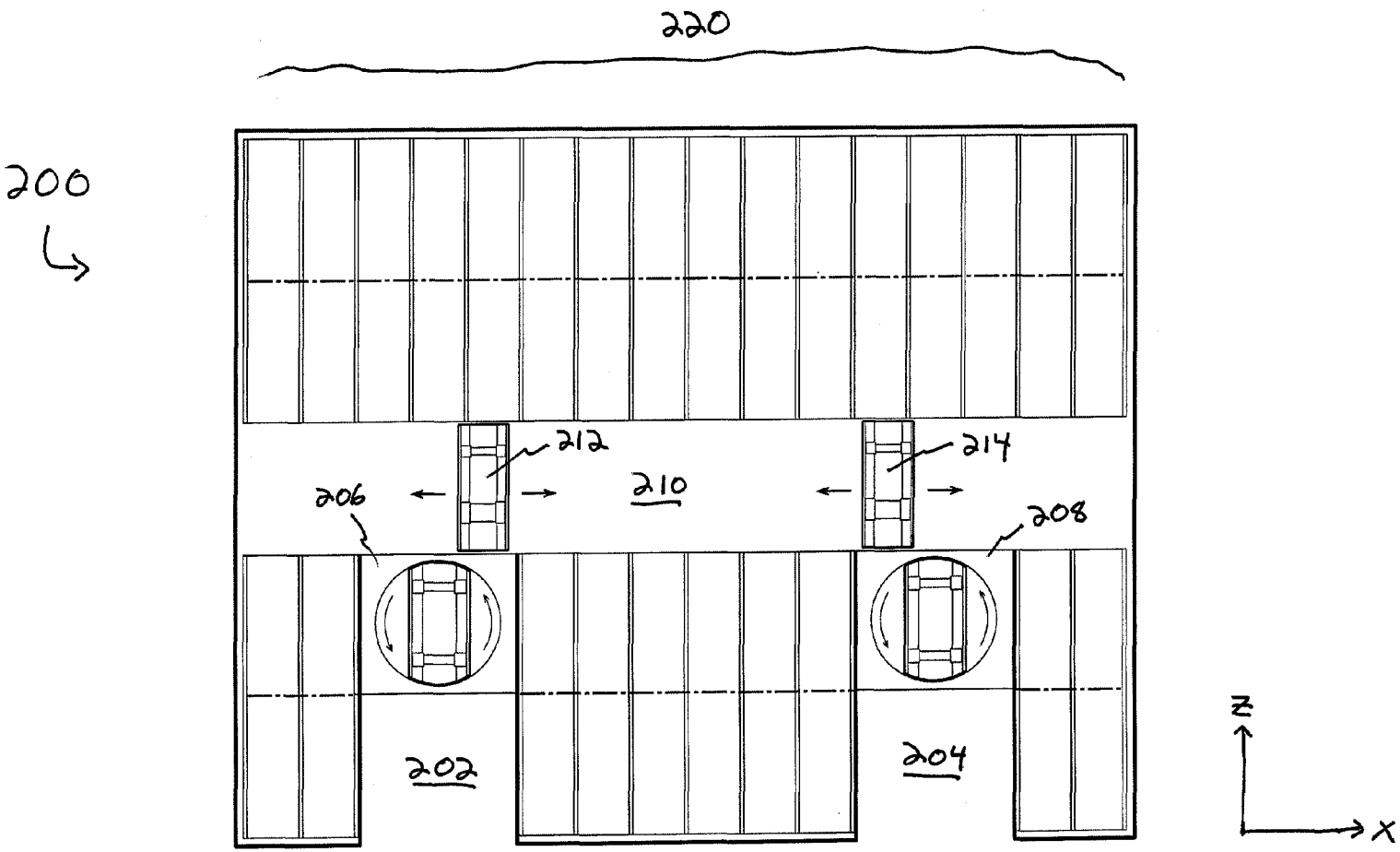
FIG. 2 is a top plan view of the ground floor (entry/exit level) of the automated parking garage.

FIG. 2 shows the ground floor/entrance floor 200 of the automated vehicle parking garage 100. The entrance floor 200 is the floor that contains the entry/exit bays 202, 204 into which the driver can drive his vehicle. As noted above, alternative embodiments may contain separate entry and exit bays. Additionally, the bays could be located on different physical floors if necessary or desired. For instance, an automated garage 100 located on a sloping property could have entry/exit bays on different levels to accommodate the physical topology of the property site.

In some embodiments, the entry/exit bays 202, 204 contain turntables or other mechanical means for rotating a vehicle about a vertical axis. Such turntables enable the vehicle to be rotated, if necessary, such as to orient the vehicle to face outward towards the street in a combined entry/exit bay.

The automated parking garage 100 contains one or more vehicle elevators 206, 208 which are capable of transporting the vehicle from one floor to another. In some embodiments, a sliding or rolling door separates the entry/exit bay 202, 204 from the elevators 206, 208. In other embodiments, an elevator is integrated directly into the entry/exit bay. In various embodiments, the vehicle elevators 206, 208 contain turntables or other mechanical means to rotate the vehicle about a vertical axis. Such turntables can advantageously rotate the vehicle so it can be positioned for transport by the shuttle cars, as further described below.

Figure 3:
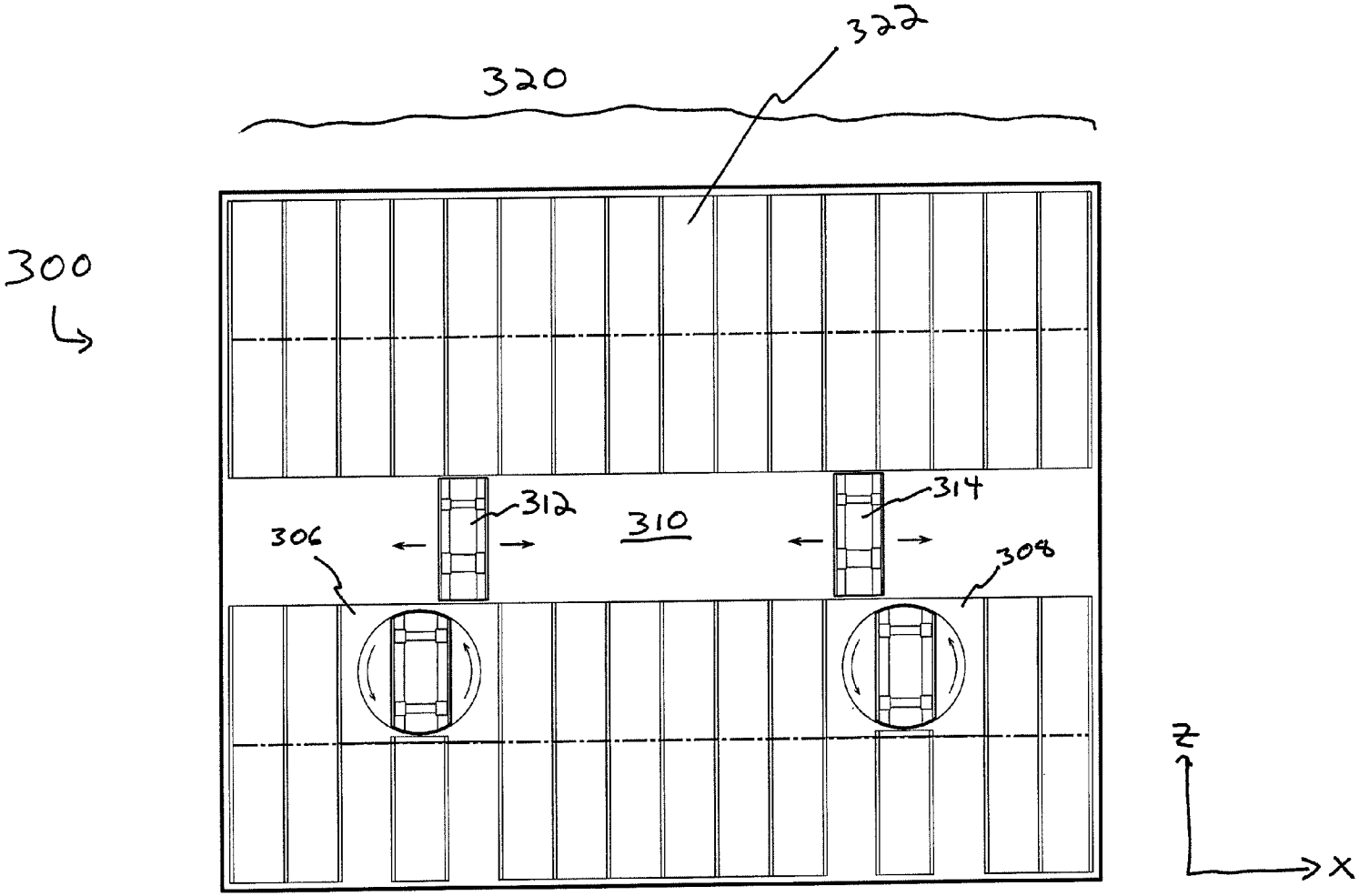
FIG. 3 is a top plan view of a floor other than the ground floor (entry/exit level) of the automated parking garage.

Turning to FIG. 3, a depiction of a non-entrance floor 300 is shown. Each automated parking garage 100 may have a plurality of non-entrance floors 300 as well as one or more entrance floors 200 as described previously. Each non-entrance floor 300 will contain elevator shafts 306, 308 for accommodating the vehicle elevators 206, 208 as they transport vehicles among the various floors of the garage 100.

With respect to FIGS. 2 and 3, all floors of the parking garage 100 may contain a plurality of parking spaces 220, 320 in various configurations. Some embodiments have an identical layout on all non-entrance floors 300 for purposes of simplicity and cost. Such a layout is not necessary, however. In some embodiments, the entrance floor 200 or one or more non-entrance floors 300 may contain offices, shops, or other non-parking space.

Advantageously, in some embodiments the parking spaces 220, 320 are oriented in the same direction as the entry/exit bays 202, 204 and the elevators 206, 208 to eliminate the need to rotate the vehicles on a turntable. In other embodiments, it may be necessary to orient the parking spaces 220, 320 in a different direction such as to accommodate the physical shape of a parcel of land. In such a situation, turntables or other mechanical means can be used to rotate the vehicles as needed.

As depicted in FIGS. 2 and 3, each floor has a shuttle pathway 210, 310 that runs along the width (x-axis) of the building. The shuttle pathway 210, 310 is used by the x-shuttles 212, 214, 312, 314 for transporting vehicles along the shuttle pathway 210, 310 in a lateral motion. In some embodiments, the shuttle pathway 310 on a non-entrance floor 300 will comprise an empty space with no solid floor. As described in more detail below, each x-shuttle 212, 214, 312, 314 can carry z-shuttles which in turn carry a vehicle.

With respect to FIGS. 2 and 3, each floor can be characterized as having a width (x-axis) and a depth (z-axis). In FIGS. 2 and 3, the x-axis runs from left to right in the same direction as the shuttle pathway 210, 310. The z-axis runs from bottom to top of FIGS. 2 and 3. As described below, z-shuttles travel in the direction of the z-axis to transport a vehicle from an x-shuttle into a parking space 220, 320.

Shuttle Cars

Figure 4:
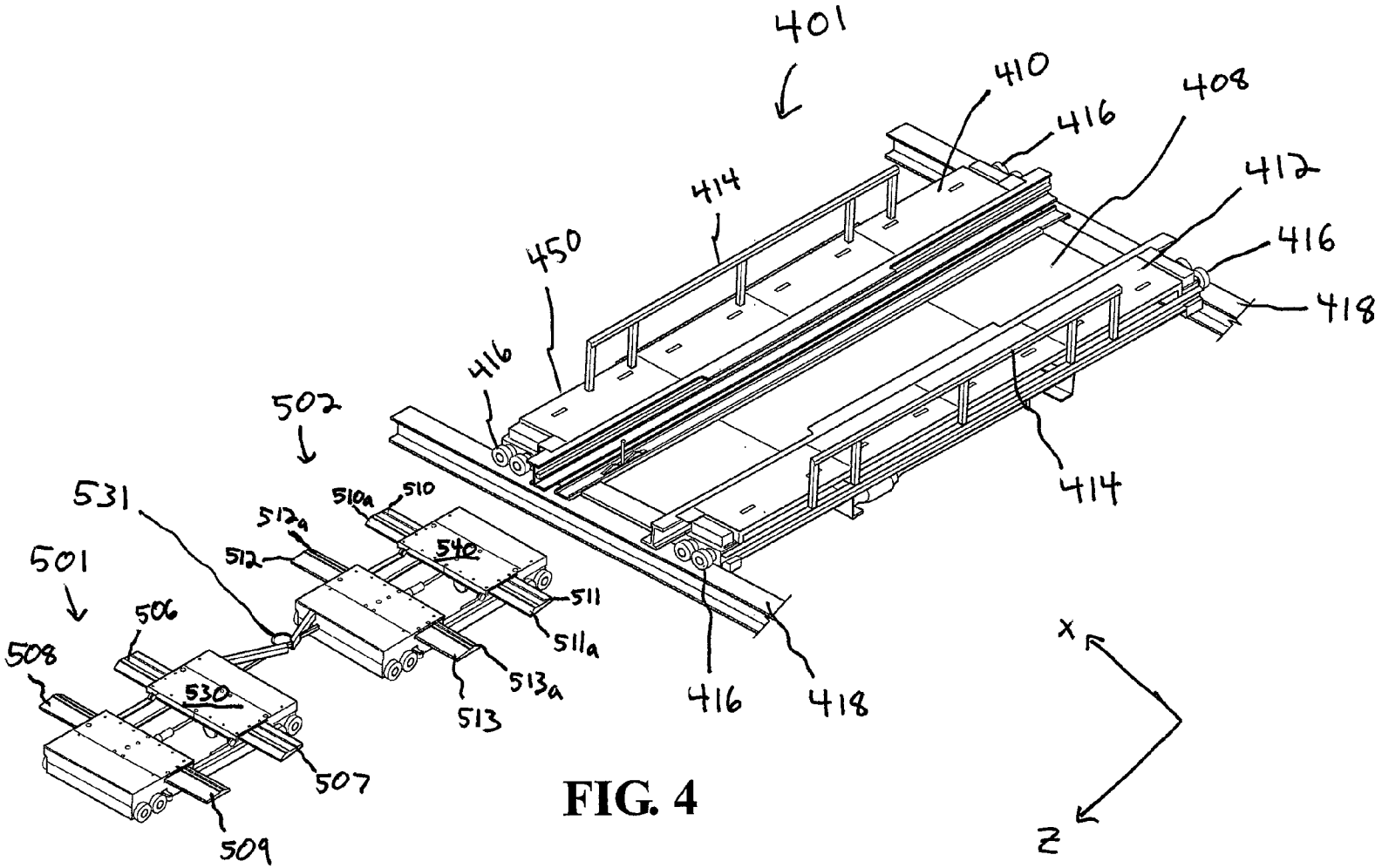
FIG. 4 is a perspective view of an x-shuttle and two z-shuttles showing the z-shuttles removed from the x-shuttle.
Figure 5:
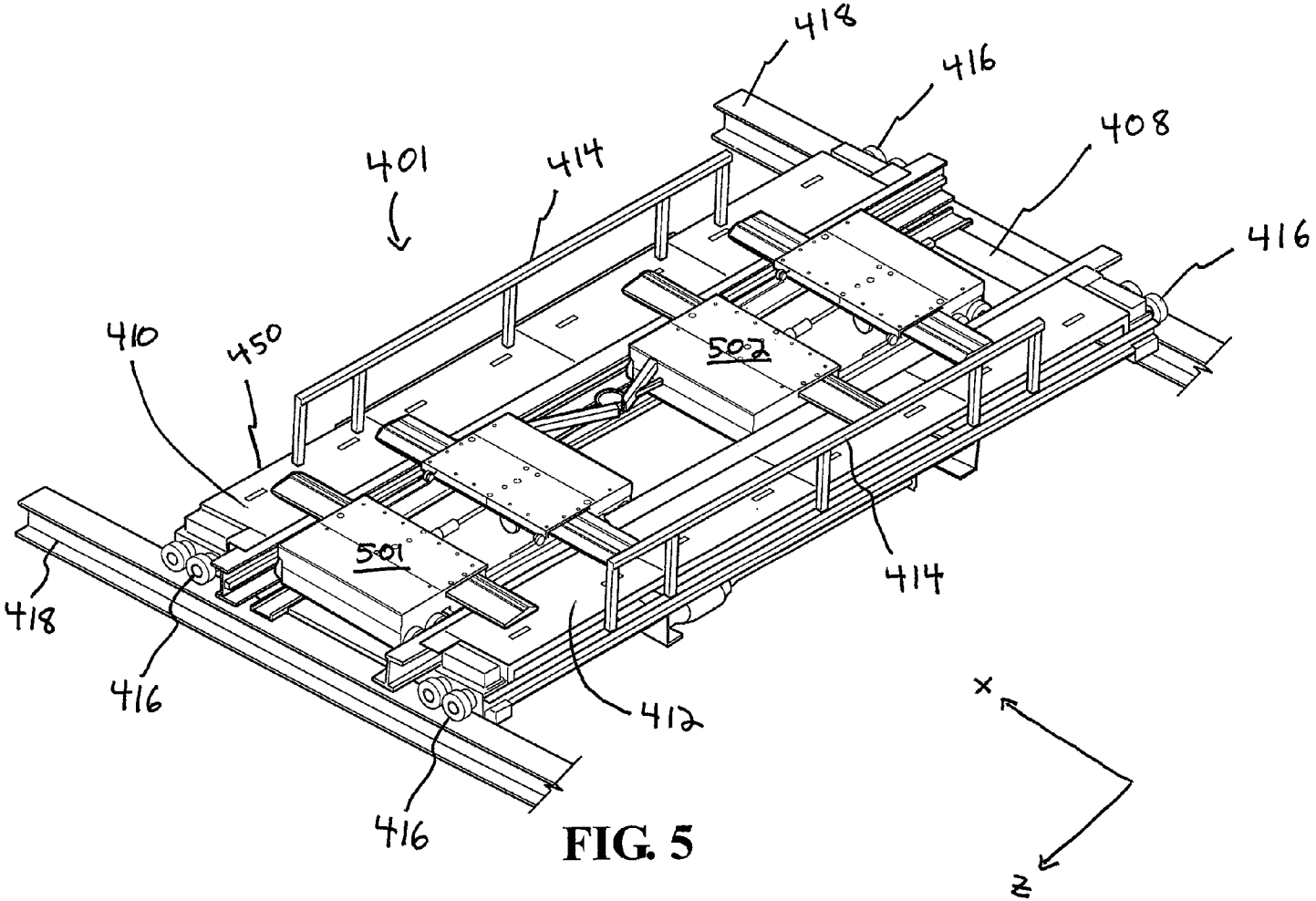
FIG. 5 is a perspective view of two z-shuttles resting on an x-shuttle.
Figure 6:
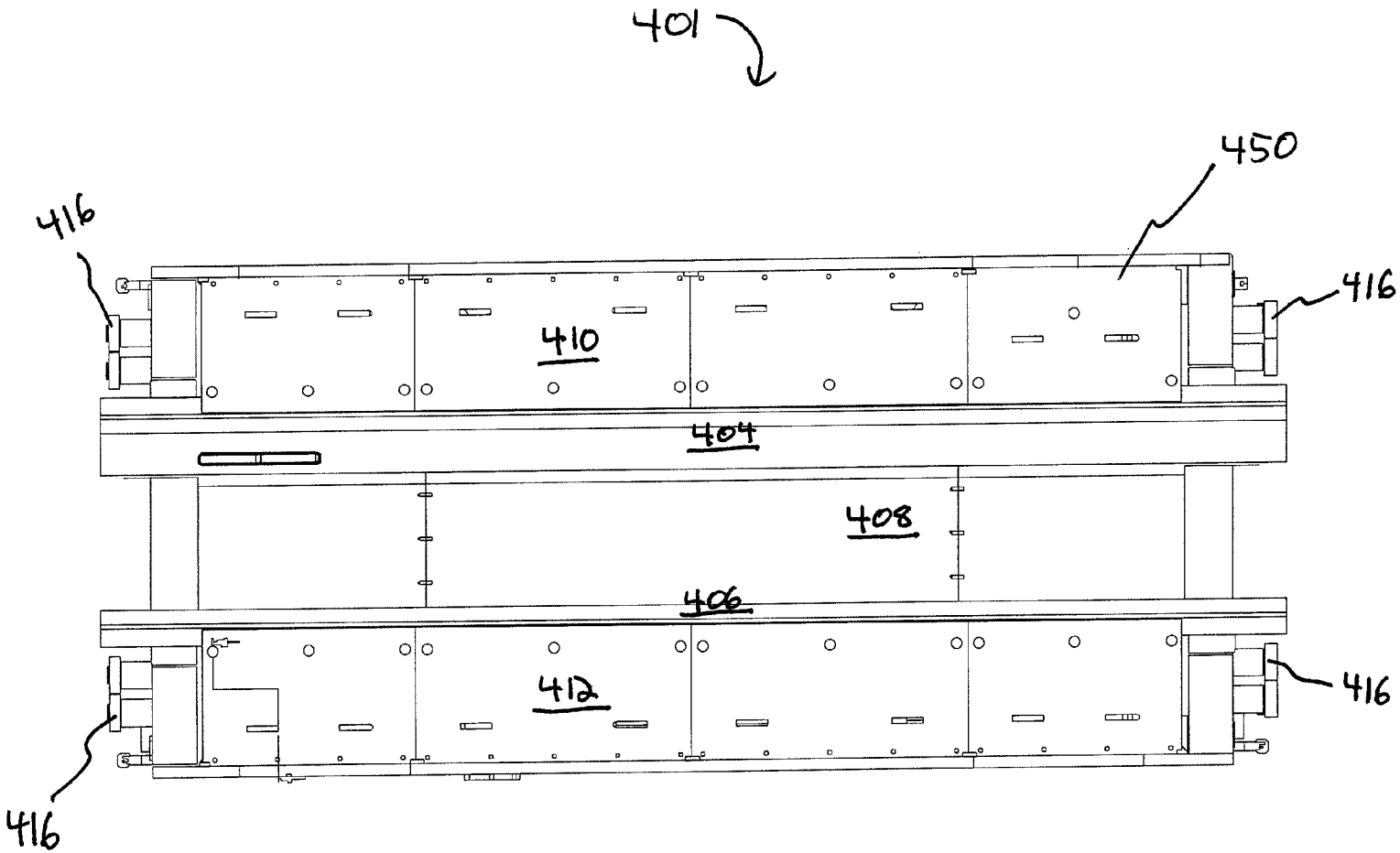
FIG. 6 is a top plan view of an x-shuttle.
Figure 7:
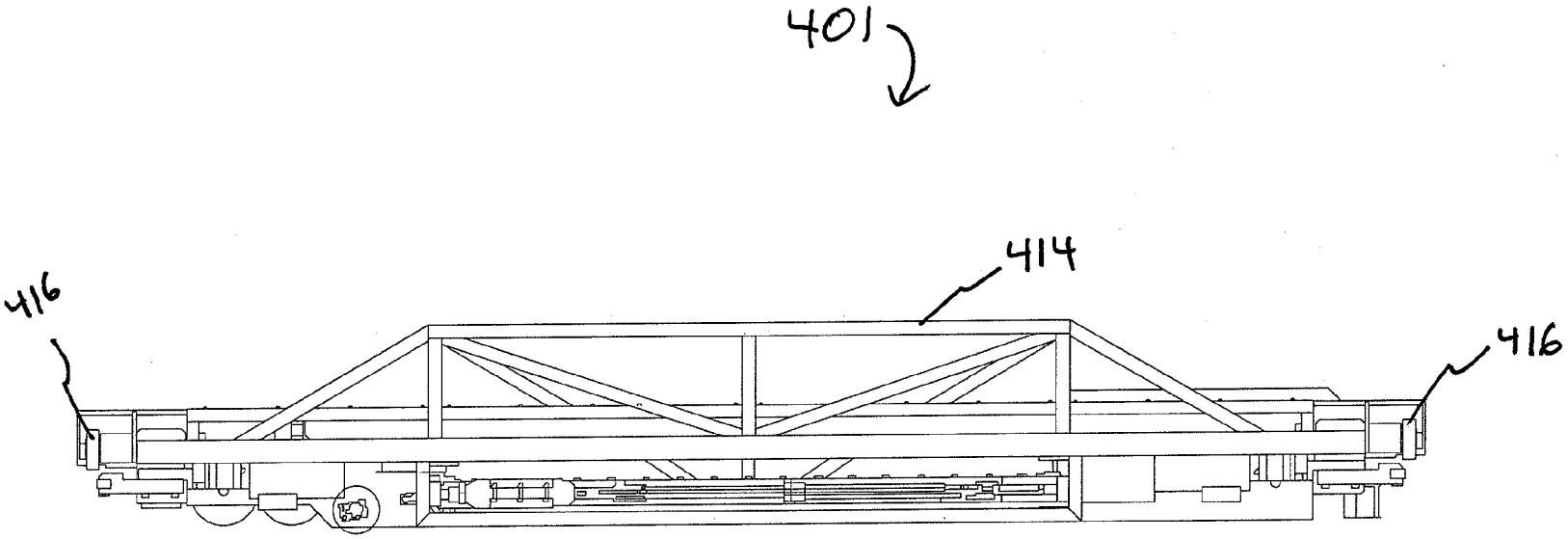
FIG. 7 is a side elevation view of an x-shuttle.
Figure 11:
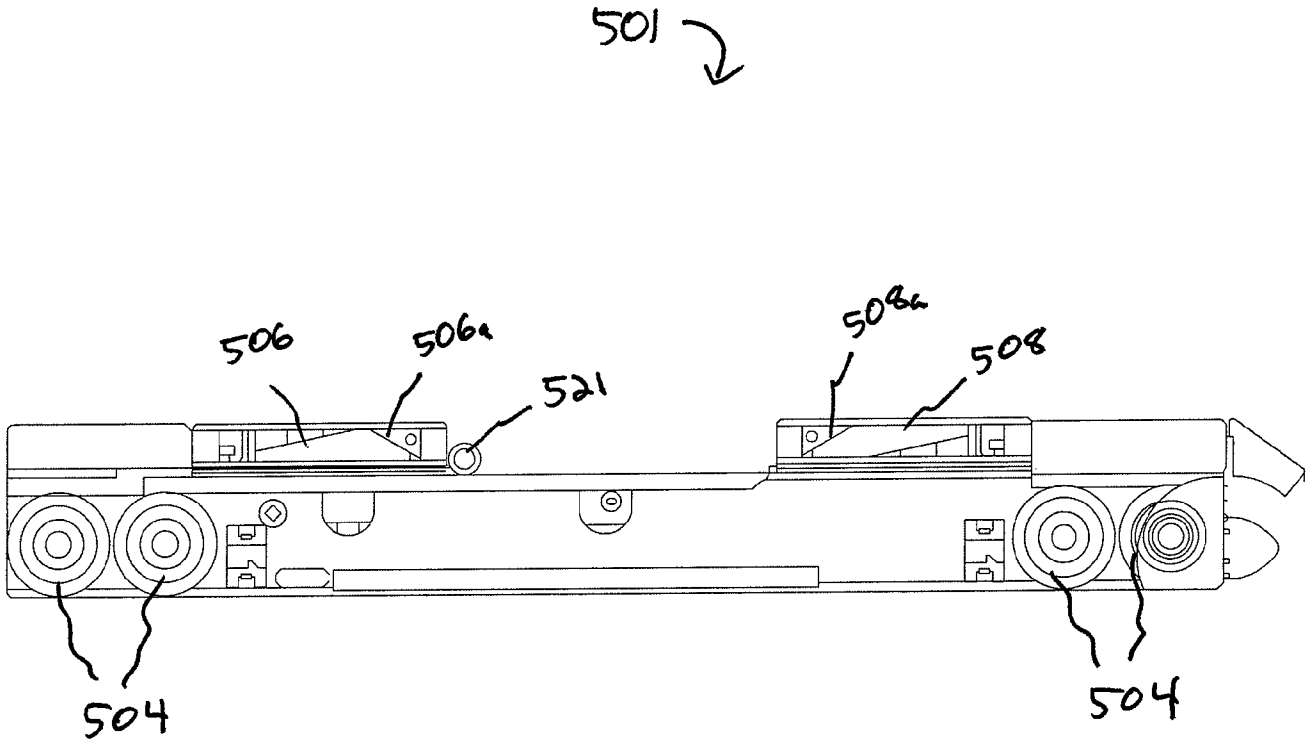
FIG. 11 is a side view of a z-shuttle.
Figure 12:
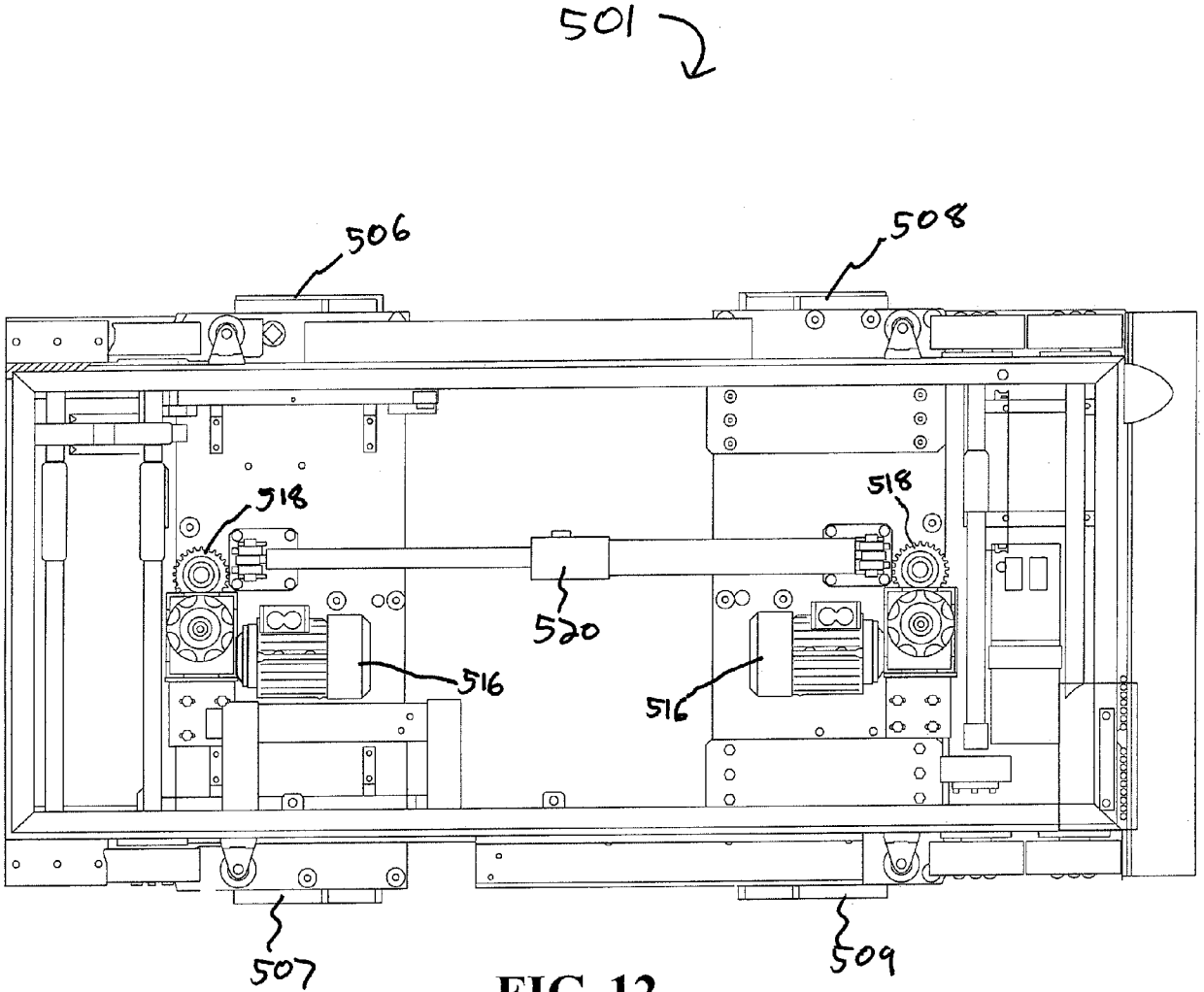
FIG. 12 is a bottom view of a z-shuttle.
Figure 13:
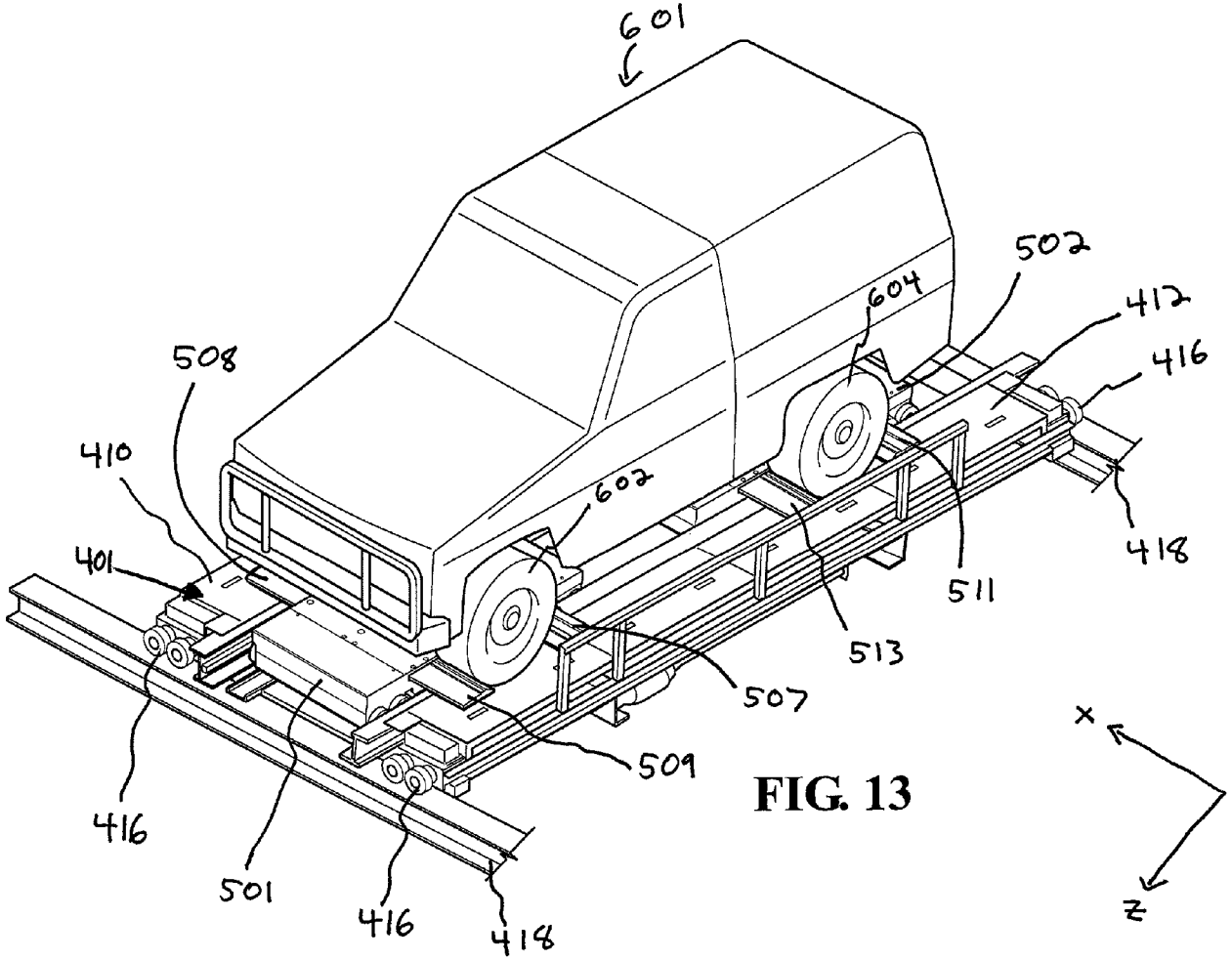
FIG. 13 is a perspective view of a vehicle resting on two z-shuttles, which are in turn resting on an x-shuttle.

Turning to FIGS. 4-13, an x-shuttle 401 and two z-shuttles 501, 502 are depicted in various configurations of one embodiment. FIG. 5 shows the two z-shuttles 501, 502 resting on the x-shuttle 401 with their wheels 504 lying in the appropriate z-shuttle tracks 404, 406 on the x-shuttle 401. FIG. 4 shows the z-shuttles 501, 502 after they have traveled some distance in the z-direction from the x-shuttle 401. FIG. 13 shows a vehicle 601 resting on the z-shuttles 501, 502, which are in turn resting on the x-shuttle 401.

i) X-Shuttles

As shown in detail in FIGS. 4 and 6-8, one embodiment of the x-shuttle 401 comprises an essentially flat platform 450 with a central recessed area 408 for holding the z-shuttles 501, 502. The x-shuttle 401 contains two vehicle wheel paths 410, 412 onto which a vehicle can be placed or driven. Each of the two vehicle wheel paths 410, 412 is wide enough to accommodate the width of tires of any conventional passenger vehicle. The two vehicle wheel paths 410, 412 are likewise spaced at an appropriate distance from one another to accommodate the varying separation ("track") between left and right wheels of conventional passenger vehicles. In embodiments, the x-shuttle 401 may contain side handrails 414 to prevent falls when maintenance personnel access the x-shuttle while it is suspended on an upper level of the parking garage 100.

In various embodiments, the x-shuttle 401 has several sets of wheels 416 which are mounted on rails 418. Rails 418 run along the shuttle pathways 210, 310 (FIGS. 2-3) to allow the x-shuttle 401 to move laterally along the shuttle pathways 210, 310. Each x-shuttle 401 contains one or more motors located behind panels 428 (FIG. 8) or other means to propel it along the shuttle pathway 210, 310. Likewise, each x-shuttle 401 preferably contains a battery, fuel cell, fuel tank, or other source of energy. Alternatively, the x-shuttle 401 may obtain energy from a remote power source through the use of bus bars running along the rails 418, an electrical cable, contactless power transmission source, or other means.

Each floor 200, 300 (FIGS. 2-3) of the automated parking garage 100 may contain x-shuttles 212, 214, 312, 314 for transporting vehicles along the shuttle pathways 210, 310. Preferably, a given floor 300 will contain at least as many x-shuttles 312, 314 as elevators 306, 308 to minimize wait times. Some embodiments may have fewer x-shuttles than elevators on one or more floors to minimize costs or in the event an x-shuttle is removed for maintenance.

In some embodiments, the x-shuttles 312, 314 may lie on a solid floor rather than being mounted on rails 418. In such embodiments, the shuttle pathway 310 must comprise a solid floor rather than an empty space.

In some embodiments, the x-shuttles 312, 314 may enter and exit elevators 306, 308 and travel inside the elevators 306, 308 from one floor to another. Advantageously, the elevators 306, 308 in such embodiments may be located along shuttle pathway 310 or at the ends of shuttle pathway 310 so the x-shuttles 312, 314 may enter and exit the elevators 306, 308 quickly. In such embodiments, the elevators 306, 308 may be equipped with rails to allow the x-shuttles 312, 314 to enter and exit the elevators 306, 308. To facilitate the transfer of an x-shuttle 312, 314 to an elevator 306, 308 equipped with rails, it is preferable that each set of wheels 416 (FIG. 5) of the x-shuttle 401 comprise a plurality of wheels 416 to enable the x-shuttle 401 to travel over the gap between the rails 418 of the shuttle pathway 310 (FIG. 3) and the elevator's rails.

Figure 8:
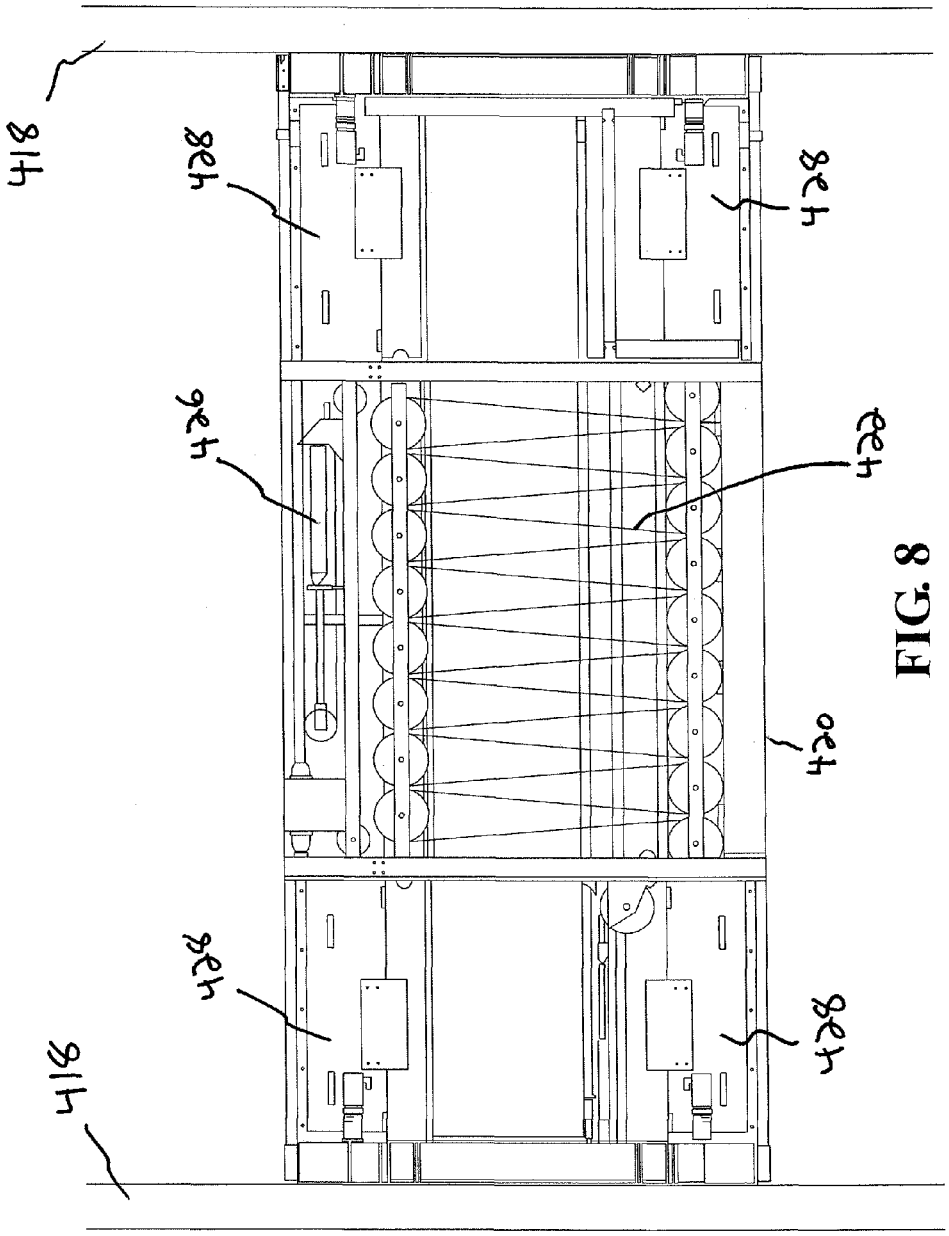
FIG. 8 is a bottom view of an x-shuttle.

Turning to FIG. 8, some embodiments of the x-shuttles 401 comprise a cable compartment 420 for storing a retractable cable 422. The cable compartment 420 is preferably a single self-contained unit that is mounted on the underside of x-shuttle 401 and can be quickly and easily detached from the x-shuttle 401 to allow maintenance personnel to quickly remove and replace a damaged or non-functioning cable 422. The retractable cable 422 is used to provide electrical power and/or communications signals to the z-shuttles 501, 502 as they travel away from the x-shuttle 401. A hydraulic cylinder 426 on the x-shuttle operates to extend or retract cable 422 into or out of cable compartment 420 according to the movement of the z-shuttles 501, 502. In alternate embodiments, electrical or other means extend or retract cable 422 instead of hydraulic cylinder 426.

In various embodiments, the x-shuttle 401 contains A/C motors, servo motors, and/or frequency converters for propelling the x-shuttle 401 along the shuttle pathways 210, 310. Redundant systems may be provided to ensure that the x-shuttle 401 will still function even if one of the systems fails. The x-shuttles 401 may also contain computer memory and programmable logic controllers or other controller devices for controlling the movement of the x-shuttles 401 and providing other control functions, as needed. The x-shuttles 401 may also contain communications equipment to enable the x-shuttle 401 to communicate with remote systems such as the z-shuttles 501, 502 or a computer system containing the location of the various vehicles in the parking garage 100. Such communications can be by wired or wireless means. The motors, frequency converters, controllers, computer memory, and communications equipment are preferably housed in self-contained compartments that can be quickly and easily detached from the x-shuttle 401 to provide for quick and easy maintenance.

ii) Z-Shuttles

Figure 9:
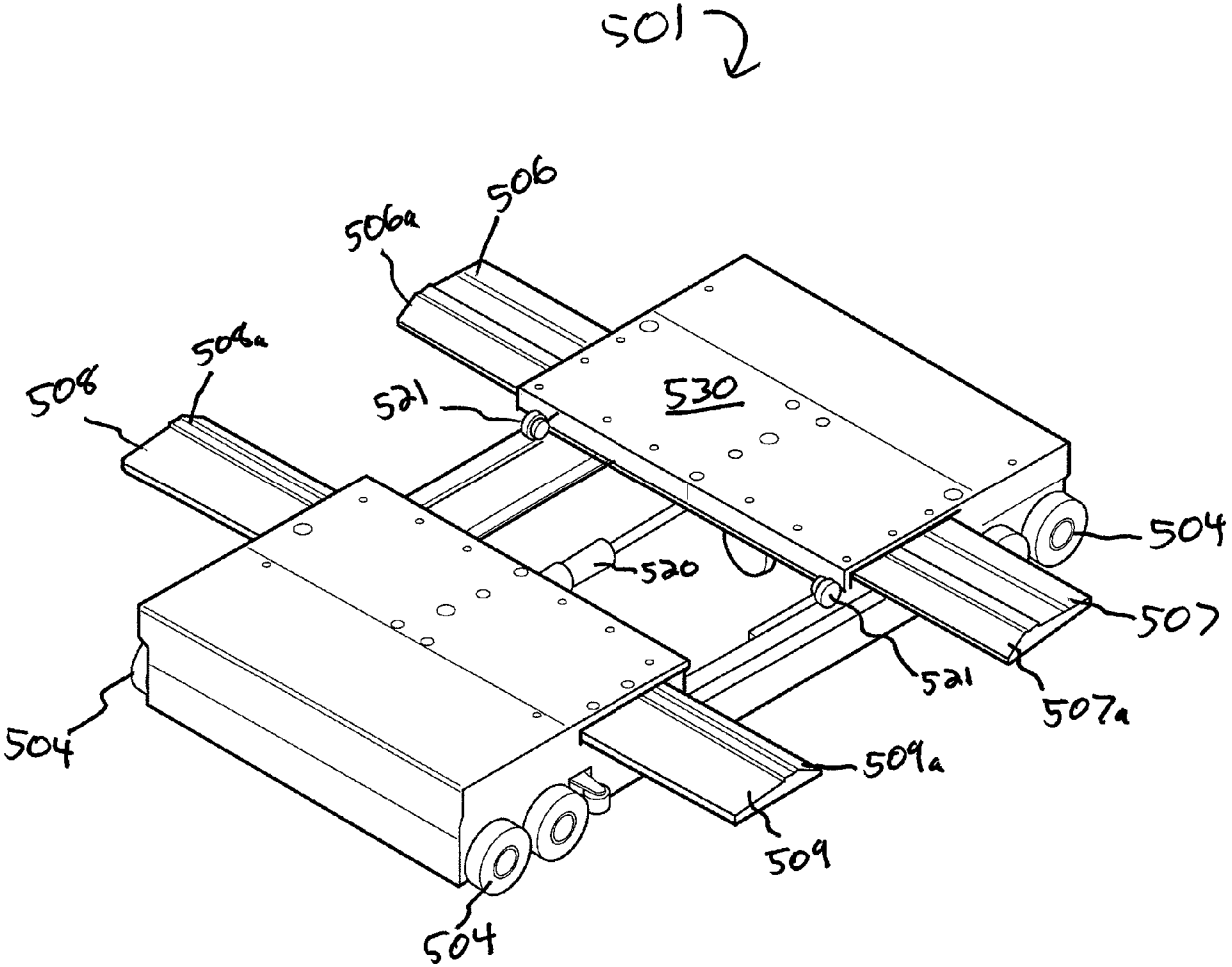
FIG. 9 is a perspective view of a z-shuttle.
Figure 10:
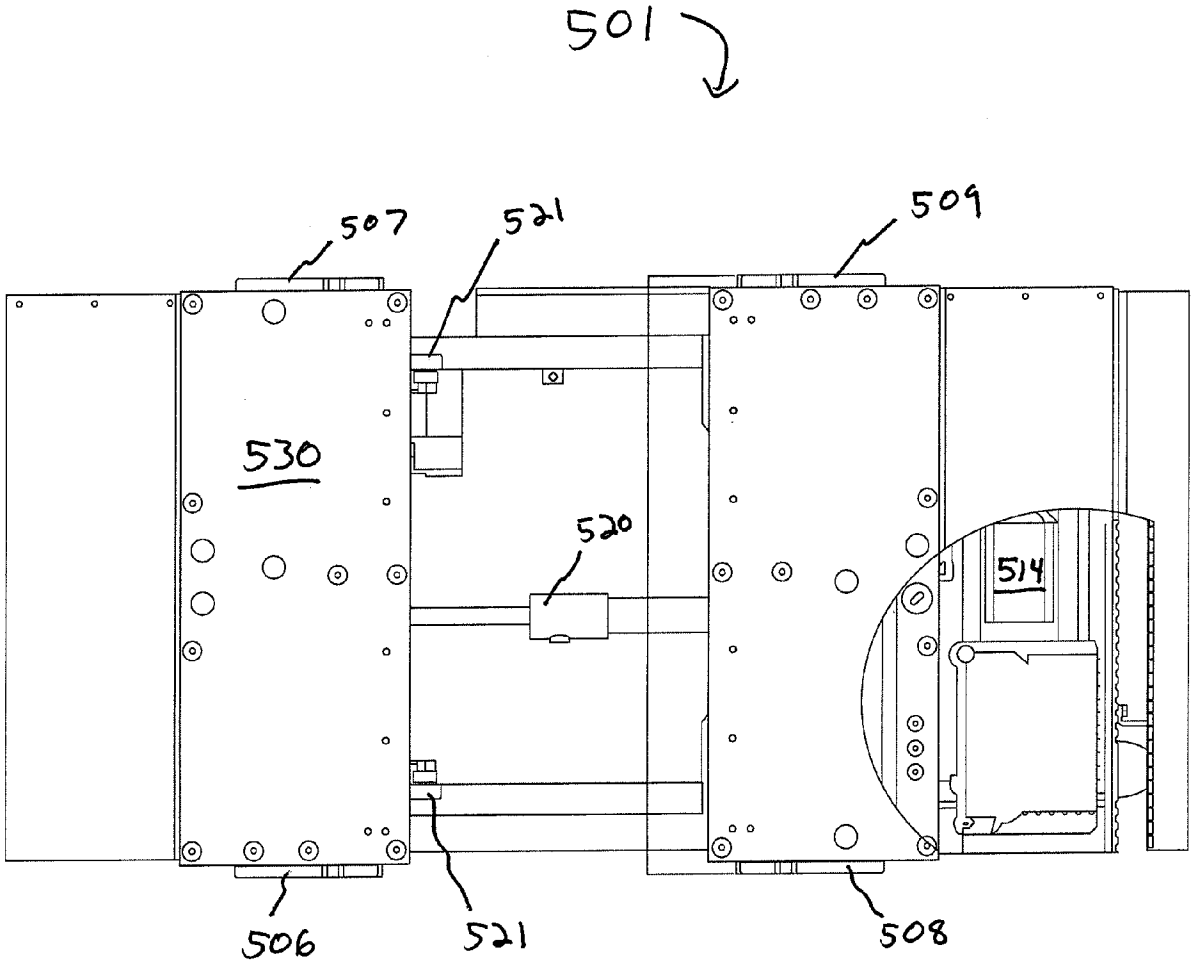
FIG. 10 is a top plan view of a z-shuttle.

FIGS. 4 and 9-12 depict the details of the z-shuttles 501, 502 in one embodiment. Each z-shuttle 501 comprises a low-profile cart or platform with wheels 504 and a motor 514 or other means of propelling the shuttle. Each z-shuttle 501 has four retractable members 506, 507, 508, 509 that are utilized to lift a vehicle and hold it in place during transport, as described more fully below. Retractable members 506, 507, 508, 509 are capable of being retracted toward the center of z-shuttle 501 as depicted in FIGS. 10 and 12.

In some embodiments, one pair of retractable members 506, 507 is mounted inside a movable platform 530, which can be driven by a hydraulic cylinder 520 or other means. As needed, movable retractable members 506, 507 can be moved in the direction of stationary retractable members 508, 509 to lift tires 602, 604 up off of the ground and secure the tires 602, 604 in place during transport. In other embodiments, both pairs of retractable members are mounted on movable platforms and can be simultaneously moved towards one another or away from one another. In some embodiments, additional hydraulic, electric, or other means lift retractable members 506, 507, 508, 509 or the entire chassis of z-shuttle 501 in a vertical direction to lift tires 602, 604 off the ground.

Turning to FIG. 12, each z-shuttle 501 preferably contains one or more retracting motors 516 for retracting and extending the retractable members 506, 507, 508, 509. The retracting motors 516 engage gears 518 which engage the retractable members 506, 507, 508, 509 to retract or extend them.

As shown in FIGS. 9 and 11, each retractable member 506, 507, 508, 509 presents a sloping wing-like surface 506*a*, 507*a*, 508*a*, 509*a* towards the middle of z-shuttle 501. These wing-like surfaces 506*a*, 507*a*, 508*a*, 509*a* allow the z-shuttle 501 to lift the tires 602, 604 (FIG. 13) of vehicle 601 off the ground and firmly grip the tires 602, 604 to immobilize the vehicle 601. This firm grip advantageously allows the shuttle cars to move the vehicle 601 at high speeds through the parking garage 100 and allows for rapid acceleration and deceleration without losing a grip on the vehicle 601.

Various embodiments of the z-shuttle 501 also contain sensors 521 for detecting the position and spacing of the tires 602, 604 of a vehicle 601. The sensors 521 in embodiments can be implemented using cameras, photodetectors, laser detectors, or the like. In various embodiments, the sensors 521 can measure the distance between a reference point on the front tire 602 and a reference point on the rear tire 604. In some embodiments, the sensors 521 can also measure the location of the front tire 602 and rear tire 604 in relation to a fixed scale such as a ruler running the length of an entry/exit bay 202 (FIG. 2) or a vehicle elevator 206 (FIG. 2). As described below, the measurements taken by sensors 521 allow for the z-shuttles 501, 502 to space the proper distance between themselves as they travel from the x-shuttle 401 to a parking space to retrieve a vehicle.

In embodiments, the z-shuttles 501, 502 contain a battery, fuel cell, fuel tank, or other source of energy. This energy source is used to power the motor 514 or other propelling means. Alternatively, the z-shuttles 501, 502 may obtain power from a remote power source such as bus bars, a contactless power source, or a power cable. In one embodiment, a retractable cable 422 (FIG. 8) can be stored in a cable compartment 420 on the underside of an x-shuttle 401. This retractable cable 422 can provide electrical power and/or communications signals to the z-shuttles 501, 502.

In some embodiments, the z-shuttles 501, 502 can be connected by a flexible joint 531 (FIG. 4). The flexible joint 531 may hold a cable that provides electrical power and/or communications signals from one z-shuttle 502 to the other z-shuttle 501. In such embodiments, a retractable cable 422 from the x-shuttle 401 may be connected to the first z-shuttle 502 to provide electrical power and/or communications signals. In turn, the first z-shuttle 502 can provide electrical power and/or communications signals to the second z-shuttle 501 through a cable inside flexible joint 531. The flexible joint 531 can move to allow the z-shuttles 501, 502 to space themselves out at an adequate distance to respectively engage the front and rear tires 602, 604 of a vehicle 601 (FIG. 13).

The z-shuttles 501, 502 may also contain programmable logic controllers or other controllers to control the movement of the z-shuttles 501, 502 and operate other on-board systems including the sensors 521. The z-shuttles 501, 502 may also contain communications equipment for communicating with each other, the x-shuttle 401, or a remote computer system containing the location of the various vehicles in the parking garage 100. Such communication can be by wired or wireless means.

Operation of Shuttle Cars

In operation, a driver of a vehicle 601 will drive his vehicle into an entry bay 202 (FIG. 2) and into a vehicle elevator 206. In some embodiments, the vehicle elevator 206 may be integrated into the entry bay 202. The vehicle elevator 206 may also include a turntable to rotate the vehicle if necessary.

In various embodiments, the entry bay 202 or the vehicle elevator 206 contains sensors for measuring the distance between a reference point on the vehicle's front tire 602 (FIG. 13) and a reference point on the vehicle's rear tire 604. Alternatively, or in addition, the sensors can measure the absolute location of the vehicle's tires in reference to a fixed measurement, such as a ruler. Similar to the sensors 521 (FIG. 9) contained on a z-shuttle 501, the sensors in the entry bay 202 or vehicle elevator 206 can be implemented using cameras, photodetectors, laser detectors, or the like.

After measuring the distance between the vehicle's front tire 602 and its rear tire 604, the sensors can store the measurement in a computer system. As described more fully below, the z-shuttles 501, 502 can utilize this measurement to properly space themselves from one another as they travel towards the vehicle 602 to retrieve it. Advantageously, the system described herein saves time because the z-shuttles 501, 502 can properly space themselves from one another during transit from the x-shuttle 401 to the vehicle 601. Thus, the z-shuttles 501, 502 will be properly spaced by the time they reach the vehicle 601 and will not waste time locating the vehicle's tires or spacing themselves properly.

After parking the vehicle in the entry bay 202 (FIG. 2) or vehicle elevator 206, the driver can leave the vehicle 601 and retrieve a ticket or token from a kiosk or a human attendant. Optionally, the driver can make a pre-payment for parking and specify an estimated time for picking up the vehicle.

After the spacing between the vehicle's tires has been measured, the vehicle 601 is transported to the appropriate floor in the vehicle elevator 206. Preferably, an automated computer system will calculate the destination parking space 322 (FIG. 3) where vehicle 601 will be stored. Alternatively, a human operator can decide the floor and destination parking space 322 to place the vehicle 601.

While the vehicle is in transit to the appropriate floor, an x-shuttle 312 (FIG. 3) can position itself in front of the elevator shaft 306 in preparation for retrieving the vehicle 601. The x-shuttle 312 will be loaded with a pair of z-shuttles 501, 502 with their retractable members in the retracted position. After the vehicle 601 reaches the appropriate floor, the z-shuttles 501, 502 will travel off of the x-shuttle 312 and underneath the vehicle 601. The z-shuttles 501, 502 will space themselves appropriately based on the tire location and spacing information previously calculated by sensors in the entry bay 202 or vehicle elevator 206. As described above, this information can be communicated to the z-shuttles 501, 502 by wireless or wired means and processed by the onboard communications systems housed in the z-shuttles 501, 502. In various embodiments, the z-shuttles 501, 502 may use proximity detectors such as laser detectors to measure the spacing between them.

As the z-shuttles 501, 502 travel underneath the vehicle 601, the z-shuttles 501, 502 in some embodiments will use their sensors 521 to respectively locate or confirm the location of the front tires 602 and rear tires 604 of the vehicle 601. In other embodiments, the z-shuttles will position themselves inside the vehicle elevator 306 with respect to a fixed scale such as a ruler. To properly position themselves in the vehicle elevator 306, the z-shuttles 501, 502 preferably utilize the tire location and spacing information previously measured for the vehicle 601 to assist them in locating the vehicle's tires 602, 604.

After positioning themselves at the front tires 602 and rear tires 604, respectively, the front z-shuttle 501 and the rear z-shuttle 502 will extend their retractable members 506-513 as depicted in FIG. 4. Once extended, the movable retractable members 506, 507, 510, and 511 will move toward the stationary retractable members 508, 509, 512, and 513 respectively to engage the wheels of the vehicle and to lift the front and rear tires of vehicle 601 off the ground.

In one embodiment, the rear retractable members 506, 507 (FIGS. 4, 9) of the front z-shuttle 501 are mounted on a movable platform 530 (FIG. 9) which moves towards the front of the vehicle 601. The wing-like surfaces 506*a*, 507*a* of the rear retractable members 506, 507 push against the bottom rear surface of the vehicle's front tires, thus urging the tires up and forward onto wing-like surfaces 508*a*, 509*a* of the front retractable members 508, 509.

Similarly, the rear retractable members 510, 511 (FIG. 4) of the rear z-shuttle 502 are mounted on a movable platform 540 which moves towards the front of the vehicle 601. The wing-like surfaces 510*a*, 511*a* of the rear retractable members 510, 511 push against the bottom rear surface of the vehicle's rear tires, thus urging the tires up and forward onto wing-like surfaces 512*a*, 513*a* of the front retractable members 512, 513.

In alternate embodiments, both the front retractable members 508, 509 and the rear retractable members 506, 507 of the z-shuttle 501 are mounted on mobile platforms. In these embodiments, the front retractable members 508, 509 and the rear retractable members 506, 507 can simultaneously move towards one another to lift and grip the vehicle's tire. Likewise, the front retractable members 508, 509 and the rear retractable members 506, 507 can simultaneously move away from one another to lower the vehicle's tires.

Once the tires are firmly gripped and resting on the wing-like surfaces 506*a*-513*a* of retractable members 506-513, the z-shuttles 501, 502 will transport the vehicle 601 to the x-shuttle 401, as shown in FIG. 13. The x-shuttle 401 will then travel laterally down the shuttle pathway 310 (FIG. 3) until it is aligned with the destination parking space 322. As described above, the destination parking space 322 may be determined by an automated computer system that communicates the destination parking space 322 to the x-shuttle 401 and z-shuttles 501, 502.

Once the x-shuttle 401 is aligned with the destination parking space 322, the z-shuttles 501, 502 will transport the vehicle 601 to the destination parking space 322. In some embodiments, vehicles that obstruct the destination parking space 322 can be moved by other z-shuttles or other means.

After the z-shuttles 501, 502 have positioned the vehicle 601 in the destination parking space 322, the rear retractable members 506, 507, 510, 511 move towards the rear of the vehicle, thus allowing the vehicle's tires to slide off of wing-like surfaces 508*a*, 509*a*, 512*a*, 513*a* and onto the floor of the destination parking space 322. The retractable members 506-513 are then retracted to the center of the z-shuttles 501, 502 and the z-shuttles 501, 502 return to the x-shuttle 401 to await the retrieval of another vehicle.

Vehicle Retrieval

The process for retrieving a vehicle from a stored parking space 322 (FIG. 3) is largely the reverse of that for storing a vehicle. Upon receiving a signal to retrieve the vehicle in a particular parking space 322, an x-shuttle 312 carrying two z-shuttles 501, 502 will travel along shuttle pathway 310 until the x-shuttle 312 is aligned with the parking space 322. The z-shuttles 501, 502 will depart the x-shuttle 312 and travel under the vehicle. The z-shuttles 501, 502 will space themselves appropriately as they travel towards the vehicle, based on the tire location and spacing information previously calculated by sensors in the entry bay 202 or vehicle elevator 206. The z-shuttles 501, 502 will further utilize their sensors 521 in conjunction with the tire location and spacing information to locate the tires 602, 604 of the vehicle 601. The z-shuttles 501, 502 will lift the tires 602, 604 of vehicle 601 off the ground and transport the vehicle back to the waiting x-shuttle 312. The x-shuttle will travel along shuttle pathway 310 to the nearest available vehicle elevator 306. The z-shuttles 501, 502 will then place the vehicle into the vehicle elevator 306 and return to the x-shuttle. The vehicle elevator 306 will then transport the vehicle to the ground floor, where it can be retrieved by its owner in the entry/exit bay 202 (FIG. 2)

Alternative Embodiments: Shelving System

In alternative embodiments, the floors of the automated parking garage 100 comprise a shelving system with horizontal support beams for storing the vehicles. The beams are spaced adequately so the tires of the stored vehicles will be supported when the vehicle is stored in a parking space 322 (FIG. 3). In addition, rails or tracks are provided so the z-shuttles 501, 502 may travel from the x-shuttle 401 to the parking space 322 to store or retrieve the vehicle. These embodiments advantageously remove the necessity for constructing solid floors for storing the vehicles. In some embodiments, a lightweight, non-vehicle supporting floor, tarp, or other surface can be provided between floors to keep oil, water, melting snow, or other fluids and dirt from dripping from one vehicle onto the top of the vehicles below it. In some embodiments, a non-vehicle supporting floor can be provided between floors for maintenance purposes such as a catwalk that can hold persons but not the weight of a vehicle.

In related embodiments, an automated parking garage 100 may comprise a series of solid floors similar to a conventional garage, wherein each floor contains a shelving system that allows for multiple vehicles to be stacked on each floor. In such embodiments, the z-shuttles may advantageously lower or raise vehicles through hydraulic or other lift means. Alternatively, separate lift means may be provided to raise and lower the vehicles for placement on the shelving system.

Alternative Embodiments: Lack of Entry/Exit Bay Sensors

In alternative embodiments, the entry/exit bays 202, 204 (FIG. 2) may lack sensors for determining the tire location and spacing information for the vehicles. Instead, the location and spacing of the tires may be measured by the sensors 521 (FIG. 9) on the z-shuttles 501, 502 when they encounter a vehicle for the first time. The z-shuttles 501, 502 in such embodiments will discover the location and spacing of the vehicle's tires and communicate such measurements to the garage's automated computer system. This tire location and spacing information can be used later when the z-shuttles 501, 502 retrieve the vehicle from storage.

In a related embodiment, a pair of z-shuttles 501, 502 resides in each entry/exit bay 202, 204. This pair of z-shuttles can utilize its sensors 521 to measure the location and spacing of a vehicle's tires before placing the vehicle into the vehicle elevator 206, 208. As such, no additional sensors need be installed in the entry/exit bays 202, 204.

Accordingly, while the invention has been described with reference to the structures and processes disclosed, it is not confined to the details set forth, but is intended to cover such modifications or changes as may fall within the scope of the following claims.

What is claimed is:

1. A vehicle shuttle system for use in an automated parking garage comprising:

a first shuttle of a first type comprising an essentially flat platform with a central recessed area extending longitudinally along said first shuttle, said central recessed area acting as a guide channel accommodating shuttles of a second type; and a plurality of shuttles of a second type, each of said shuttles of said second type comprising:

a low-profile platform;

a plurality of retractable members adapted to extend and retract along a transverse axis;

means for extending and retracting said retractable members along said transverse axis; and means for propelling the shuttle of the second type back and forth between said central recessed area and a parking space having a flat channel-free surface;

wherein said retractable members are adapted to lift and firmly hold the tires of a passenger vehicle, and further adapted to lower said tires to directly contact said flat channel-free surface.

2. The vehicle shuttle system of claim 1 wherein each of said retractable members comprises sloping wing-like surfaces on at least one edge of said retractable member.

3. The vehicle shuttle system of claim 2 wherein at least one pair of retractable members located along a single transverse axis of each of said shuttles of said second type is capable of movement along a longitudinal axis of said shuttle of said second type.

4. The vehicle shuttle system of claim 3 wherein each of said plurality of shuttles of said second type further comprises a sensor adapted to sensing the location of a tire proximate the sensor.

5. The vehicle shuttle system of claim 1 wherein:

said first shuttle of said first type further comprises communications equipment for communicating the location of said passenger vehicle or an empty parking space, and each of said plurality of shuttles of said second type further comprises communications equipment for communicating the location of said passenger vehicle or an empty parking space.

6. The vehicle shuttle system of claim 1 wherein said first shuttle of said first type further comprises a cable compartment for storing a retractable cable.

7. The vehicle shuttle system of claim 6 wherein said cable compartment is detachable from said first shuttle.

8. The vehicle shuttle system of claim 6 wherein said cable is adapted to provide electrical power or communications signals to said plurality of shuttles of said second type.

9. The vehicle shuttle system of claim 1 wherein said first shuttle further comprises wheels adapted for movement on rails in a transverse direction.

10. An automated method for storing a vehicle in a parking space having a flat channel-free surface in a three-dimensional warehousing facility utilizing a first shuttle of a first type having a central recessed area which acts as a guide channel and accommodates shuttles of a second type, and two shuttles of a second type, the method comprising:

receiving the vehicle in an entry bay;

measuring the distance between a first reference point on a front tire and a second reference point on a rear tire;

vertically moving the vehicle to a parking level containing the parking space using an elevator;

positioning said two shuttles of said second type inside the central recessed area on said first shuttle;

aligning said shuttles with said vehicle;

placing one of said shuttles of said second type at a set of rear tires of said vehicle with first retractable members retracted along a transverse axis;

placing one of said shuttles of said second type at a set of front tires of said vehicle with second retractable members retracted along a transverse axis;

extending said first and second retractable members from said shuttles of said second type along each transverse axis;

simultaneously lifting said front and rear tires onto the respective shuttles of said second type;

transporting said vehicle to said first shuttle;

aligning the shuttles with said parking space;

transporting said vehicle to the parking space;

simultaneously lowering the front and rear tires of the vehicle so that the tires directly contact the flat channel-free surface of the parking space; and returning said shuttles of said second type to the first shuttle;

wherein said shuttles of the second type are adapted to move back and forth between the central recessed area and the parking space.

11. The method of claim 10 wherein said shuttles of said second type utilize sensors to determine the location of the set of rear tires and the set of front tires.

12. The method of claim 10 wherein said shuttles of said second type pre-arrange the spacing between them based on the measurement of the distance between said first reference point on said front tire and said second reference point on said rear tire.

13. The method of claim 10 further comprising urging the set of front tires and the set of rear tires onto wing-like surfaces on said first and second retractable members simultaneously.

14. An automated method for retrieving a vehicle from a parking space having a flat channel-free surface in a three-dimensional warehousing facility utilizing a first shuttle of a first type having a central recessed area which acts as a guide channel and accommodates shuttles of a second type, and two shuttles of a second type, the method comprising:

retrieving a previously measured distance between a set of front tires of said vehicle and a set of rear tires of said vehicle;

positioning said two shuttles of said second type inside the central recessed area on said first shuttle;

aligning said shuttles with said vehicle;

moving said shuttles of said second type toward said vehicle;

spacing said shuttles of said second type at a distance corresponding to said previously measured distance;

placing one of said shuttles of said second type at the set of front tires of said vehicle;

placing one of said shuttles of said second type at the set of rear tires of said vehicle;

simultaneously lifting off the flat channel free surface said front and rear tires onto the respective shuttles of said second type;

transporting said vehicle from the parking space to said first shuttle;

aligning the shuttles with an elevator;

transporting said vehicle to the elevator;

vertically moving the vehicle to an exit level; and placing the vehicle in an exit bay;

wherein said shuttles of the second type are adapted to move back and forth between the central recessed area and the parking space.

15. The method of claim 14 wherein said shuttles of said second type utilize sensors to determine the location of the set of rear tires and the set of front tires.

16. The method of claim 14 wherein said shuttles of said second type utilize retractable members retracted along said transverse axis to perform the simultaneous lifting of said front and rear tires onto the respective shuttles of said second type.

17. The method of claim 16 further comprising urging the set of front tires and the set of rear tires onto wing-like surfaces on said retractable members.

18. A vehicle shuttle system for use in an automated parking garage comprising:

a first shuttle of a first type comprising an essentially flat platform with a central recessed area extending longitudinally along said first shuttle, said central recessed area acting as a guide channel accommodating shuttles of a second type; and a plurality of shuttles of a second type having retractable members adapted to lift and firmly hold the tires of a passenger vehicle and means for propelling the shuttle back and forth between said central recessed area and a parking space having a flat channel-free surface, and wherein said retractable members are adapted to lower said tires to directly contact said flat channel-free surface.

19. A method for automatically parking a vehicle in a multi-story parking facility having parking spaces with flat channel-free surfaces comprising:

loading the vehicle onto a first shuttle of a first type comprising an essentially flat platform with a central recessed area extending longitudinally along said first shuttle, said central recessed area acting as a guide channel accommodating shuttles of a second type;

aligning said first shuttle of said first type with an empty parking space;

lifting the front tires of the vehicle onto a first shuttle of said second type and lifting the rear tires of the vehicle onto a second shuttle of said second type;

propelling said first and second shuttles of a second type back and forth between said central recessed area and said parking space, and lowering the vehicle onto said parking space such that the vehicle tires are in direct contact with the flat channel-free surface.

* * * * *